US009153896B2

(12) United States Patent
Akagi

(10) Patent No.: US 9,153,896 B2
(45) Date of Patent: Oct. 6, 2015

(54) CONNECTOR HAVING LOCKING PARTS

(75) Inventor: Yosuke Akagi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/233,408

(22) PCT Filed: Jul. 19, 2012

(86) PCT No.: PCT/JP2012/068386

§ 371 (c)(1),
(2), (4) Date: Jan. 17, 2014

(87) PCT Pub. No.: WO2013/012052

PCT Pub. Date: Jan. 24, 2013

(65) Prior Publication Data

US 2014/0194012 A1 Jul. 10, 2014

(30) Foreign Application Priority Data

Jul. 19, 2011 (JP) ..... 2011-158292

(51) Int. Cl.
*H01R 13/514* (2006.01)
*H01R 13/506* (2006.01)
*H01R 13/436* (2006.01)

(52) U.S. Cl.
CPC ..... *H01R 13/506* (2013.01); *H01R 13/4362* (2013.01)

(58) Field of Classification Search
CPC ..... H01R 13/4362
USPC ..... 439/752
See application file for complete search history.

(56) References Cited

U.S. PATENT DOCUMENTS 7,204,726 B2 * 4/2007 Yamashita et al. ..... 439/752
2001/0049235 A1 12/2001 Furutani
2002/0132518 A1 9/2002 Kobayashi (Continued)

FOREIGN PATENT DOCUMENTS

CN 1375893 A 10/2002
JP 2001-332335 A 11/2001
JP 2002-343483 A 11/2002

(Continued)

OTHER PUBLICATIONS

English-Language Translation of Written Opinion dated Oct. 23, 2012 issued in International Application No. PCT/JP2012/068386 (PCT/ISA/237).

(Continued)

*Primary Examiner* — Tho D Ta
(74) *Attorney, Agent, or Firm* — Sughrue Mion, PLLC

(57) ABSTRACT

A spacer (20) which is inserted and installed into a spacer accommodating space (12) of a housing body (10) includes a temporary locking protrusion (25) which is equipped on an outer wall surface (21*a*) of an outside wall (21) and which engages with first component locking means (15) of the housing body (10) when the spacer (20) is moved to a temporary locking position to regulate the movement of the spacer (20) in the insertion direction, and a principal locking protrusion (26) which is equipped on an inner wall surface (21*b*) of the outside wall (21) and which engages with second component locking means (16) when the spacer (20) is moved to a principal locking position to regulate the movement of the spacer (20) in the insertion direction.

3 Claims, 7 Drawing Sheets

(56) References Cited

U.S. PATENT DOCUMENTS

| | | | |
|---|---|---|---|
| 2002/0168895 | A1 | 11/2002 | Suzuki |
| 2003/0027456 | A1 | 2/2003 | Yamawaki et al. |

FOREIGN PATENT DOCUMENTS

| | | | |
|---|---|---|---|
| JP | 2003-45546 | A | 2/2003 |
| JP | 2010-50018 | A | 3/2010 |
| JP | 2010-118150 | A | 5/2010 |

OTHER PUBLICATIONS

International Search Report dated Oct. 23, 2012 issued in International Application No. PCT/JP2012/068386 (PCT/ISA/210).

Written Opinion dated Oct. 23, 2012 issued in International Application No. PCT/JP2012/068386 (PCT/ISA/237).

Communication issued on Jul. 30, 2015 by The State Intellectual Property Office of the PR of China in related Application No. 201280036004.4.

* cited by examiner

CONNECTOR HAVING LOCKING PARTS

TECHNICAL FIELD

The present invention relates to a connector which includes a housing body and an insertion-installed component which is inserted into a component accommodating space formed in the housing body and which can be positioned at two positions. The two positions are different positions in the insertion direction and are a temporary locking position and a principal locking position.

BACKGROUND ART

To position or double lock terminal metal fittings which are installed into terminal accommodating holes, a variety of connectors in which a separate component is inserted and installed into the housing body are developed.

For such kinds of connectors, the insertion-installed component which is inserted and installed into the housing body can be positioned at two positions, which are a temporary locking position and a principal locking position, by engaging with component locking means which are equipped on the housing body side.

The temporary locking position is a position before the terminal metal fittings are positioned or double locked. The principal locking position is a position where the insertion-installed component is further pushed into the housing from the temporary locking position, and is a position where part of the insertion-installed component positions or double locks the terminal metal fittings.

FIGS. 5 to 7 show a conventional example of a connector 100 in which an insertion-installed component is inserted into a housing body. The connector 100 shown in FIGS. 5 to 7 is disclosed in the following patent document 1.

The connector 100 includes a housing body 101 and a holder 111 which is an insertion-installed component to be inserted and installed into the housing body 101.

A rear end 101*a* side of the housing body 101 becomes a terminal accommodating part 102. Although not shown in the figure, the terminal accommodating part 102 is provided with a plurality of terminal insertion holes which penetrate the housing in the front-rear direction (an arrow Y1 direction in FIG. 5) and into which terminal metal fittings are inserted and installed. A front end 101*b* of the housing body 101 is a hood part 103 to which a mating connector is fitted.

A space positioned in front of the terminal accommodating part 102 and at the inner side of the hood part 103, as shown in FIG. 6, is a component accommodating space 104 in which the holder 111 is inserted and installed. That is, the holder 111 is inserted and installed into the component accommodating space 104, which is a space that opens to the front of the housing, in a direction as shown by an arrow Y2 in FIG. 5.

As shown in FIG. 6, guiding grooves 105 extend along the insertion direction of the holder 111 on the inner surfaces of two outside walls of the housing body 101.

Outside walls 113 of the holder 111 to be described below are fitted in the guiding grooves 105 and are movable in the insertion direction.

The holder 111 is a member which holds the front end sides of the terminal metal fittings which are installed into the terminal accommodating part 102, and improves the holding precision of the terminal metal fittings. The holder 111 includes a front part wall 112 which is positioned at the front end side of the terminal accommodating part 102, and the arm-shaped outside walls 113 which extend from two sides of the front part wall 112 along the insertion direction.

Both sides of the outside walls 113 are parallel to two side walls of the hood part 103, and the outside walls 113 are belt-shaped plates which extend along the insertion direction. The upper and lower surfaces of the outside walls 113 are equipped with temporary locking parts 116 and principal locking parts 117.

The temporary locking parts 116 are protrusions which protrude upwards from upper side surfaces 113*a* of the outside walls 113. As shown in FIG. 7, the holder 111 is fixed to the temporary locking position by the engagement of the temporary locking parts 116 and first component locking means 106 which protrude from upper inner surfaces 105*a*, which are opposed to the upper side surfaces 113*a* of the outside walls 113, of the guiding grooves 105. FIG. 6 shows that the temporary locking parts 116 engage with the first component locking means 106 and the holder 111 is fixed to the temporary locking position.

The principal locking parts 117 are protrusions which protrude downwards from lower side surfaces 113*b* of the outside walls 113. When the outside walls 113 are further pushed into the guiding grooves 105 from the state as shown in FIG. 7, the principal locking parts 117 climb over second component locking means 107 which protrude from lower inner surfaces 105*b* of the guiding grooves 105, and engage with the second component locking means 107.

The lower inner surfaces 105*b* of the guiding grooves 105 are surfaces which are opposed to the lower side surfaces 113*b* of the outside walls 113.

When the principal locking parts 117 climb over the second component locking means 107, and engage with the second component locking means 107, the holder 111 is fixed to the principal locking position.

CITATION LIST

Patent Documents

Patent document 1: Japan Patent Publication No. 2002-343483

SUMMARY OF INVENTION

Technical Problem

However, for the connector 100 disclosed in the patent document 1, the temporary locking parts 116 and the principal locking parts 117 are protrusions which protrude from the upper and lower side surfaces of the outside walls 114 along the wall surfaces in the up-down direction. Therefore, when the temporary locking parts 116 and the principal locking parts 117 are attached/detached to/from the component locking means 106 and 107 of the housing body 101 side, compressive deformations along the outer surfaces of the outside walls 114 in the up-down direction are necessary. Generally, by the compression in the plane direction, the side surfaces of a plate material are difficult to be bended.

Thus, for the connector 100 of the patent document 1, notches 113*c* are formed at central parts of the outside walls 113 to make the upper and lower side surfaces 113*a* and 113*b* which are provided with the temporary locking parts 116 and the principal locking parts 117 easy to be bended. Since the notches 113*c* are formed, the upper and lower side surfaces 113*a* and 113*b* of the outside walls 113 become beams which have small board thickness and become easy to be bended.

However, since the notches 113*c* are provided, the strength of the outside walls 113 decreases, and when the holder 111 is repeatedly attached/detached to/from the housing body, the outside walls 113 may be deformed or damaged.

If the notches 113*c* are not provided to prevent the strength of the outside walls 113 from decreasing, since the upper and lower side surfaces 113*a* and 113*b* which are provided with the temporary locking parts 116 and the principal locking parts 117 are difficult to be bended, and when the temporary locking parts 116 and the principal locking parts 117 are attached/detached to/from the component locking means 106 and 107, the resistant force increases, there is a problem which is that the holder 111 is difficult to be installed.

Thus, an object of the present invention is to solve the above problems, and to provide a connector for which the insertion-installed component is easy to be installed into the housing body, and even if the insertion-installed component is repeatedly attached/detached to/from the housing body, the insertion-installed component can be prevented from being deformed or damaged. Furthermore, another object of the invention is to provide a connector for which the fixing strength of the insertion-installed component at the temporary locking position or the principal locking position can be improved.

Solution to Problem

The above-mentioned object of the invention is achieved by the following constructions.

(1) A connector comprising:

a housing body; and an insertion-installed component which is inserted into a component accommodating space formed in the housing body and which can be positioned at two positions, which are different positions in the insertion direction and which are a temporary locking position and a principal locking position, by component locking means which are equipped in the housing body, wherein the insertion-installed component includes:

a temporary locking part, which is equipped on one side surface of an outside wall of the insertion-installed component, and which engages with the component locking means to regulate the movement of the insertion-installed component in the insertion direction when the insertion-installed component is moved to the temporary locking position; and a principal locking part, which is equipped on the other side surface of the outside wall, and which engages with the component locking means to regulate the movement of the insertion-installed component in the insertion direction when the insertion-installed component is moved to the principal locking position, and a pressing load applied on the temporary locking part that engages with the component locking means and a pressing load applied on the principal locking part that engages with the component locking means are in opposite directions.

(2) The connector according to the above (1), wherein the housing body includes:

a first opposed wall surface which is opposed to the one side surface of the outside wall;

a second opposed wall surface which is provided to be opposed to the other side surface of the outside wall and which, together with the first opposed wall surface, sandwiches the outside wall to be movable in the insertion direction of the insertion-installed component;

a first component locking means which is equipped on the first opposed wall surface and engages with the temporary locking part when the insertion-installed component is moved to the temporary locking position; and a second component locking means which is equipped on the second opposed wall surface and engages with the principal locking part when the insertion-installed component is moved to the principal locking position.

(3) The connector according to the above (2), wherein the temporary locking part and the principal locking part are protrusions which protrude from the surfaces of the outside wall in a board thickness direction and are arranged at different positions in the insertion direction of the insertion-installed component, the temporary locking part abuts against the first opposed wall surface to regulate the principal locking part from being bended and displaced to a side of the first opposed wall surface, and the principal locking part abuts against the second opposed wall surface to regulate the temporary locking part from being bended and displaced to a side of the second opposed wall surface.

According to the construction of the above (1), the temporary locking part and the principal locking part, which are equipped on the insertion-installed component to position the insertion-installed component at the temporary locking position and the principal locking position, are provided on the surfaces of the outside wall of the insertion-installed component, and the loads which are applied on the temporary locking part and the principal locking part from the component locking means of the housing body side are the loads in the board thickness direction of the outside walls which make the outside walls easy to be bended.

Therefore, it is possible to reduce an operating force that is necessary when the temporary locking part or the principal locking part is attached/detached to/from the component locking means. In other words, the resistant force when the temporary locking part or the principal locking part of the insertion-installed component is attached/detached to/from the component locking means is reduced, and it can be easy to install the insertion-installed component into the housing body.

Besides, since the temporary locking part and the principal locking part which are equipped on the insertion-installed component are separately equipped on the outside and inside of the outside wall, the pressing load which is applied on the temporary locking part which engages with the component locking means and the pressing load which is applied on the principal locking part which engages with the component locking means are in opposite directions.

Therefore, even if the insertion-installed component is repeatedly attached/detached to/from the housing body, loads in a specific direction will not be applied continuously, and the outside wall can be prevented from being bended and deformed plastically in a specific direction or damaged.

Therefore, even if the insertion-installed component is repeatedly attached/detached to/from the housing body, the insertion-installed component can be prevented from being deformed and damaged.

A spacer which double locks terminal metal fittings or a holder which positions terminal metal fittings may be examples of the insertion-installed component which is inserted and installed into the housing body in the connector of the present invention.

According to the construction of the above (2), when the insertion-installed component is inserted and installed into the housing body, a first opposed wall surface and a second opposed wall surface equipped on the housing body sandwich the outside wall of the insertion-installed component and function as guiding parts which guide the insertion-installed component in the insertion direction.

Therefore, the operation of inserting the insertion-installed component can be stabilized and it can be easy to install the insertion-installed component.

According to the construction of the above (3), since the temporary locking part and the principal locking part on the outside wall are set to be arranged at different positions in the insertion direction of the insertion-installed component, the application points where the pressing loads (bending loads) are applied on the outside wall from the component locking means at the time of temporary locking and the application points where pressing loads (bending loads) are applied on the outside wall from the component locking means at the time of principle locking are positioned at different positions in the insertion direction of the insertion-installed component. Therefore, since the pressing loads from the component locking means are received separately on different application points, even if the insertion-installed component is repeatedly attached/detached to/from the housing body, the frequency of applying the pressing loads on the same application points is reduced by half, and the occurrence of fatigue due to repeated loads can be prevented.

According to the construction of the above (3), the two locking parts, which are the temporary locking part and the principal locking part abut against the opposed wall surfaces which face each other, respectively, to regulate the other locking part from being bended and displaced to the side opposite to the opposed wall surfaces which are opposed to the other locking part.

That is, the bending stiffness of the temporary locking part and the principal locking part is reinforced since the locking parts of the other side abut against the opposed wall surfaces and becomes the supporting points, and the fixing strength of the temporary locking parts and the principal locking parts is improved since the temporary locking part and the principal locking part engage with the component locking means.

Therefore, the fixing strength of the insertion-installed component at the temporary locking position and the principal locking position can be improved without, for example, increasing the board thickness of the outside wall.

BRIEF DESCRIPTION OF DRAWINGS

FIGS. 4A to 4C show operations of inserting and installing the insertion-installed component shown in FIG. 2 into the component accommodating space of the housing body, in which FIG. 4A is an enlarged view which shows the component locking means in the component accommodating space before the insertion-installed component is installed into the component accommodating space, FIG. 4B is an enlarged view which shows the insertion-installed component engages with the component locking means when the insertion-installed component arrives at the temporary locking position, and FIG. 4C is an enlarged view which shows the insertion-installed component engages with the component locking means when the insertion-installed component arrives at the principal locking position.

DESCRIPTION OF EMBODIMENTS

A preferred embodiment of the connector according to the present invention is described in detail with reference to the figures as follows.

Figure 1:
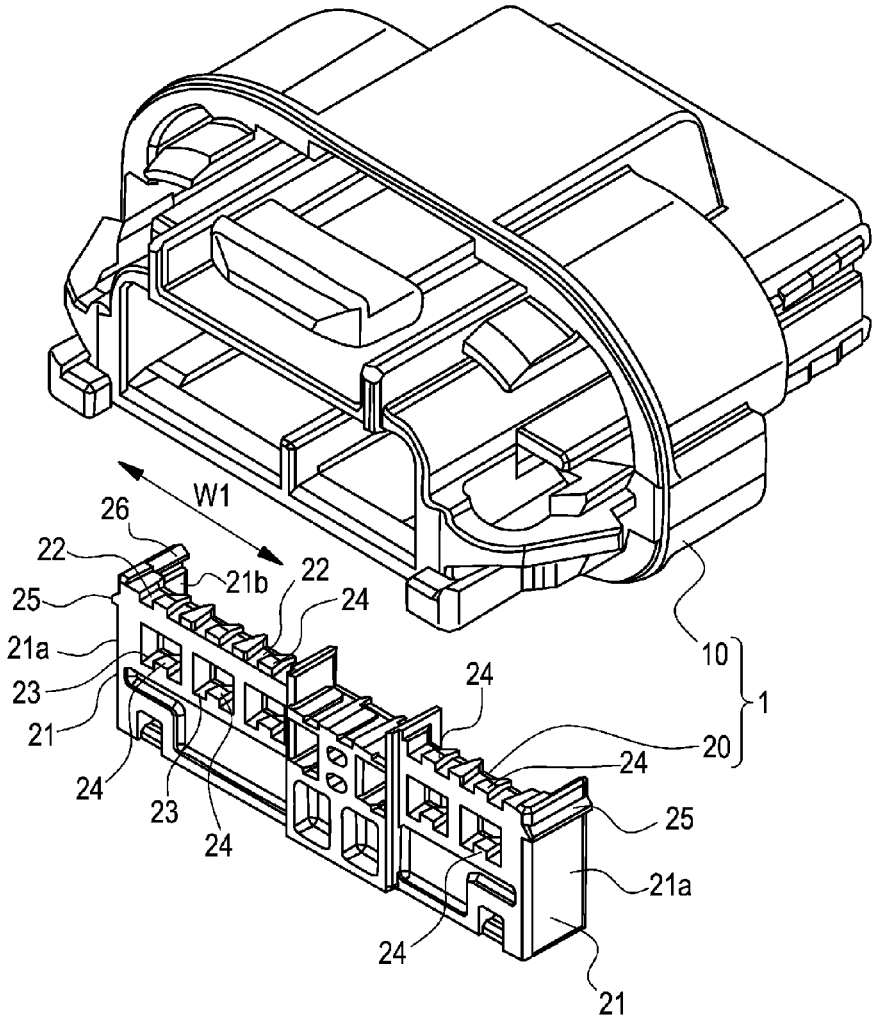
FIG. 1 is an exploded perspective view of one embodiment of the connector according to the present invention.
Figure 2:
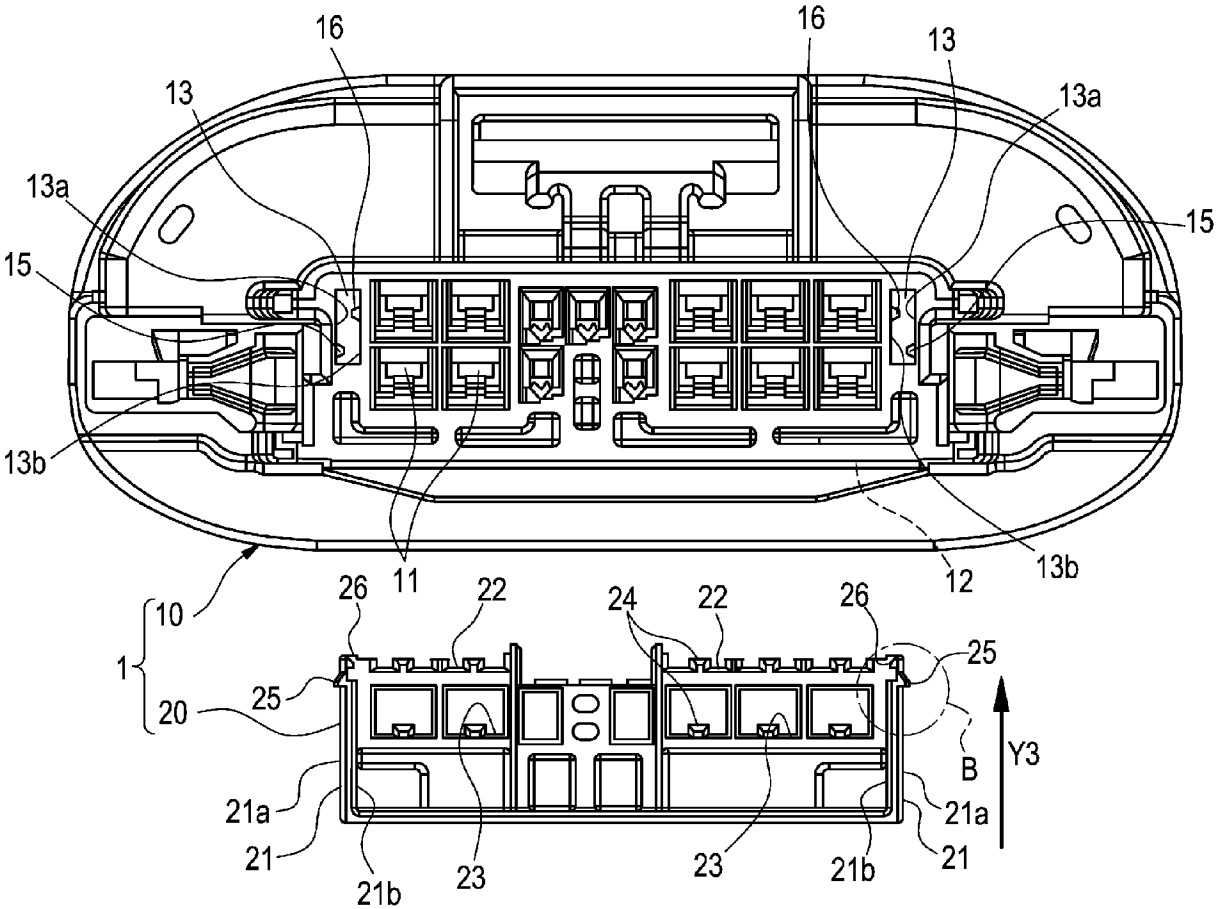
FIG. 2 is a front view of the housing body and the insertion-installed component shown in FIG. 1.
Figure 3:
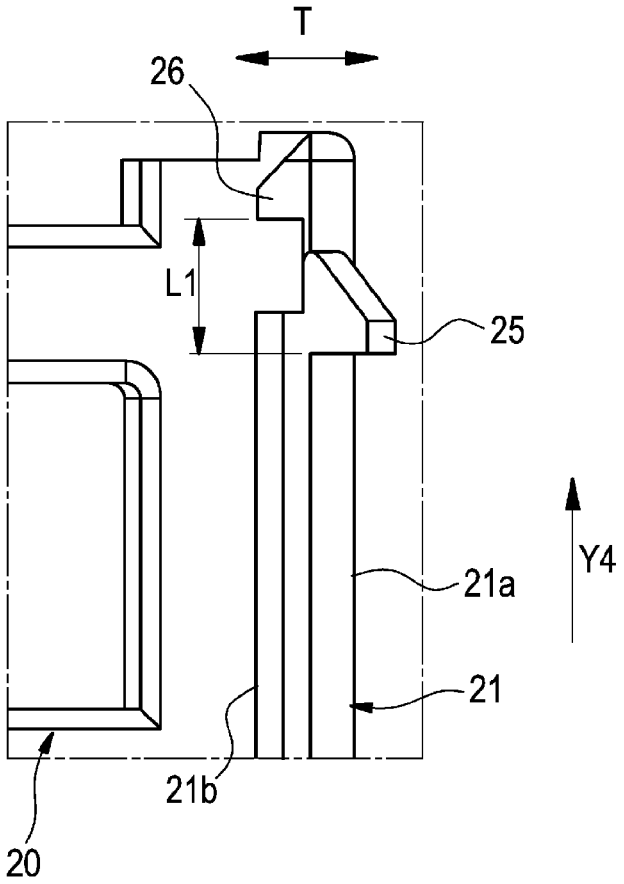
FIG. 3 is an enlarged view of a B part of the insertion-installed component in FIG. 2.
Figure 4C:
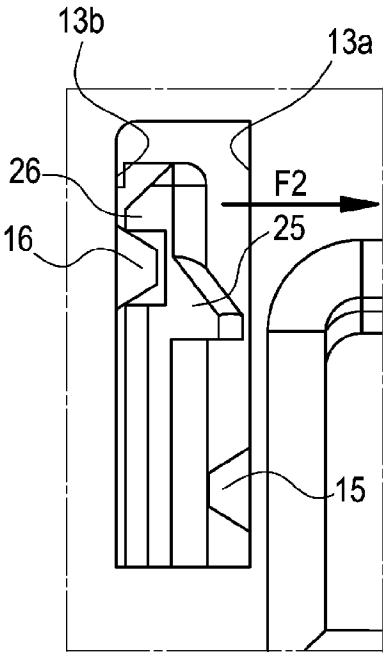

FIGS. 1 to 4C show a connector according to one embodiment of the present invention. FIG. 1 is an exploded perspective view of the connector of the embodiment. FIG. 2 is a front view of the housing body and the insertion-installed component shown in FIG. 1. FIG. 3 is an enlarged view of a B part of the insertion-installed component in FIG. 2. FIGS. 4A to 4C show operations of inserting and installing the insertion-installed component shown in FIG. 2 into the component accommodating space of the housing body, in which FIG. 4A is an enlarged view which shows the component locking means in the component accommodating space before the insertion-installed component is installed into the component accommodating space, FIG. 4B is an enlarged view which shows the insertion-installed component engages with the component locking means when the insertion-installed component arrives at the temporary locking position, and FIG. 4C is an enlarged view which shows the insertion-installed component engages with the component locking means when the insertion-installed component arrives at the principal locking position.

As shown in FIGS. 1 and 2, a connector 1 of the embodiment includes a housing body 10 and a spacer 20 which is the insertion-installed component.

The housing body 10 includes a plurality of terminal accommodating holes 11 (refer to FIG. 2) into which terminal metal fittings (not shown in the figure) are inserted and installed, and a spacer accommodating space 12 which is a component accommodating space which crosses the terminal accommodating holes. The terminal accommodating holes 11 are provided with lances which engage with the terminal metal fittings, which have been appropriately inserted, to prevent the terminal metal fittings from falling off.

The spacer accommodating space 12 is an accommodating space which opens at the lower surface side of the housing body 10 (the lower surface side in FIG. 2) and into which the spacer 20 is inserted and installed in a direction shown by an arrow Y3 in FIG. 2.

The direction shown by the arrow Y3 in FIG. 2 is a direction perpendicular to the direction that the terminal metal fittings are inserted into the terminal accommodating holes 11.

The spacer accommodating space 12 has side wall guiding spaces 13 in response to the positions of two outside walls 21 and 21, which are opposed to each other in the widthwise direction of the housing body 10 (an arrow W1 direction in FIG. 1), of the spacer 20. As shown in FIG. 2, part of the side wall guiding spaces 13 can be seen from the front of the housing body 10.

The side wall guiding spaces 13 are spaces to guide the two outside walls 21, 21 of the spacer 20 along the insertion direction when the spacer 20 is inserted into the spacer accommodating space 12.

First opposed wall surfaces 13*a* and second opposed wall surfaces 13*b*, which are opposed to each other in the widthwise direction of the housing body 10, of the side wall guiding spaces 13 define spaces into which the outside walls 21 can be inserted.

The first opposed wall surfaces 13*a* are vertical flat surfaces opposed to outside wall surfaces 21*a* on one sides of the outside walls 21. The second opposed wall surfaces 13*b* are vertical flat surfaces opposed to inside wall surfaces 21*b* on the other sides of the outside walls 21. The second opposed wall surfaces 13*b* are arranged to be opposed to the first opposed wall surfaces 13*a*, and the outside walls 21 are sandwiched by the first opposed wall surfaces 13*a* and the second opposed wall surfaces 13*b* to be movable in the direction the spacer 20 is inserted.

Figure 4B:
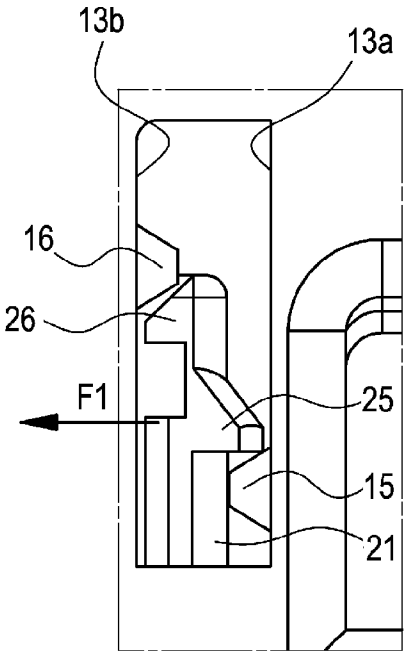
Figure 4A:
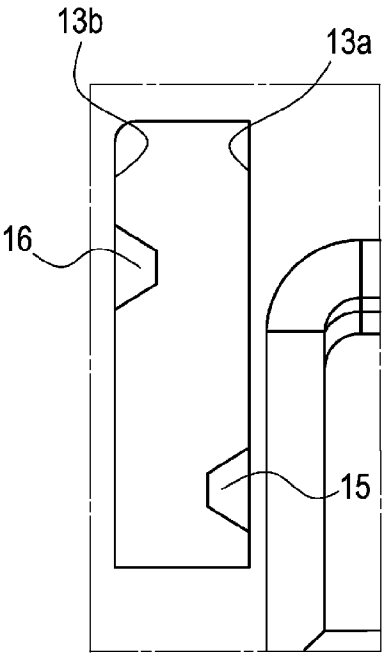
Figure 5:
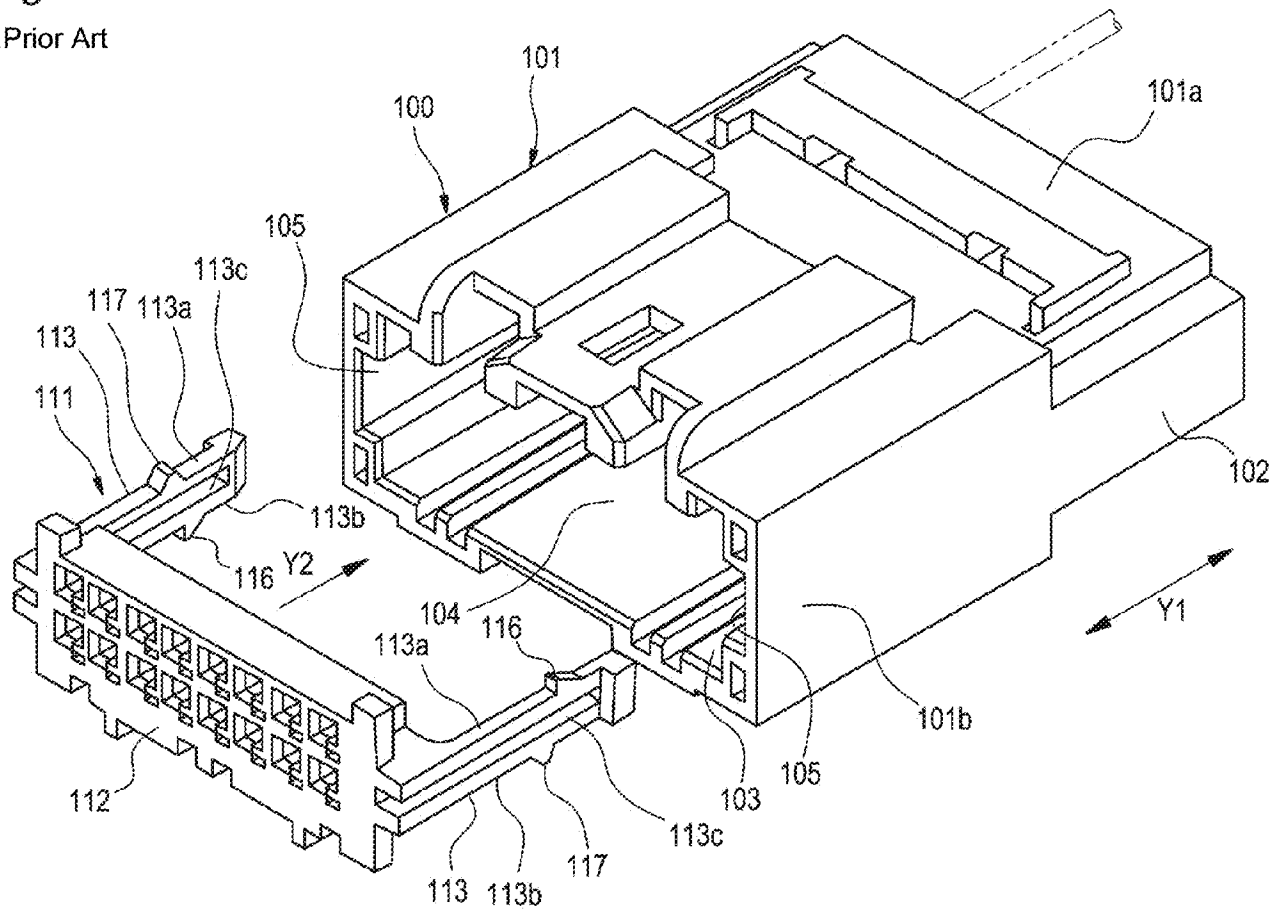
Fig. 5 Prior Art
FIG. 5 is an exploded perspective view of a conventional connector.
Figure 6:
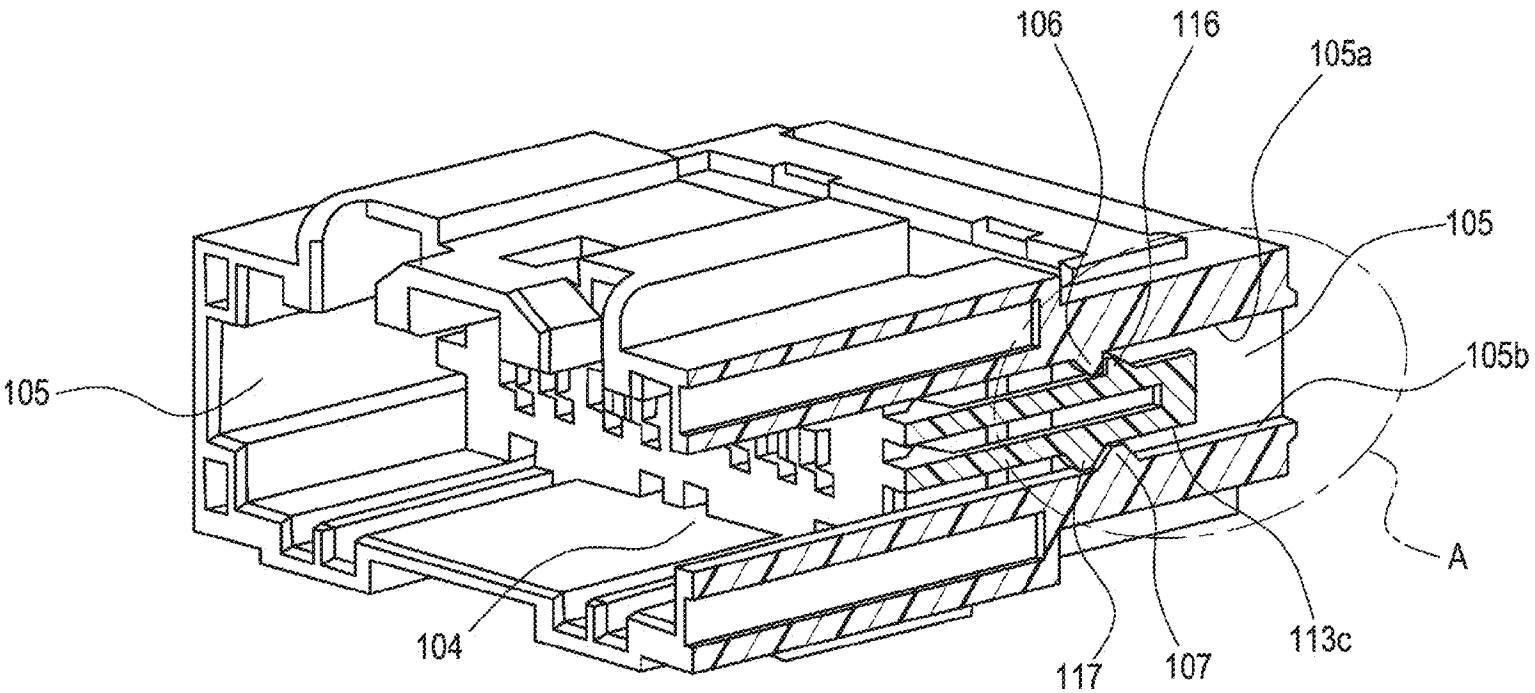
Fig. 6 Prior Art
FIG. 6 is a perspective view which shows that the holder is temporarily locked in the housing body shown in FIG. 5.
Figure 7:
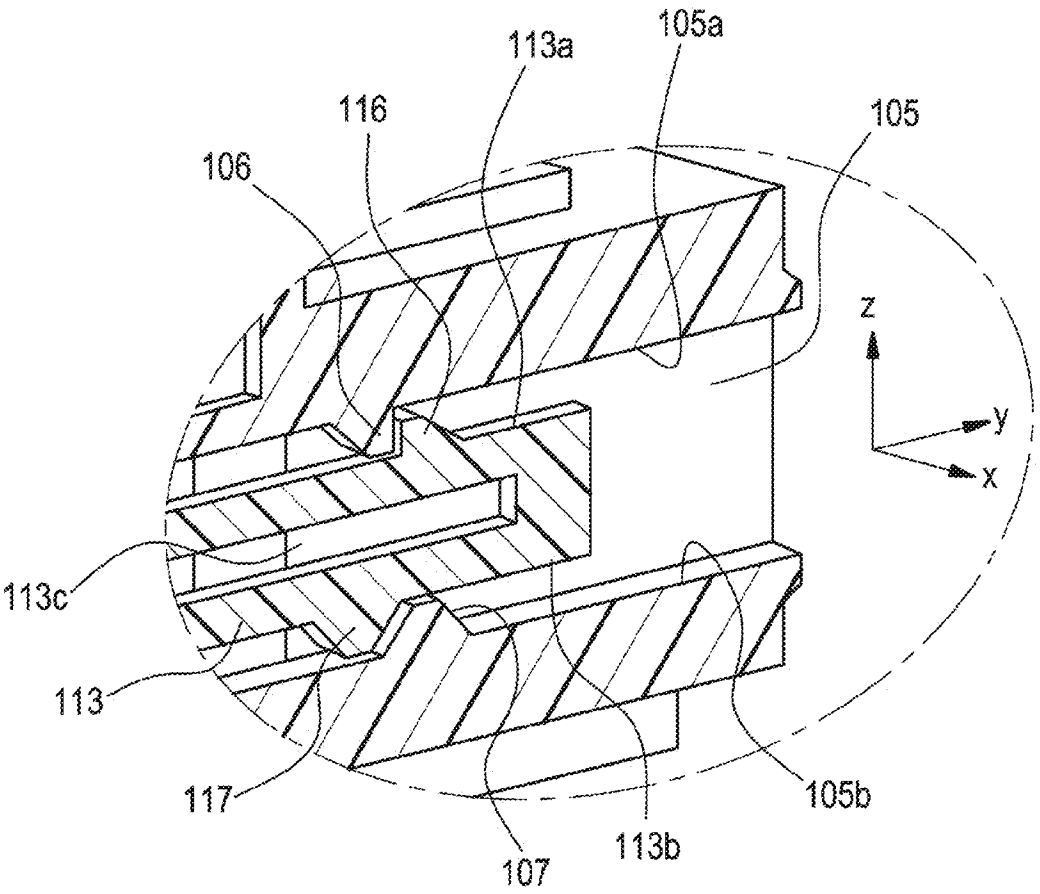
Fig. 7 Prior Art
FIG. 7 is an enlarged view of an A part in FIG. 6.

In the housing body 10 of the present embodiment, as shown in FIGS. 4A to 4C, first component locking means 15 are equipped on the first opposed wall surfaces 13*a* and second component locking means 16 are equipped on the second opposed wall surfaces 13*b*. The first component locking means 15 and the second component locking means 16 are protrusions whose cross sections are trapezoidal.

When the spacer 20 is moved to a temporary locking position to be described below, the first component locking means 15 engage with the temporary locking parts on the spacer 20 (temporary locking protrusions 25 in FIG. 3) and the spacer 20 is held (fixed) at the temporary locking position.

When the spacer 20 is moved to a principal locking position to be described below, the second component locking means 16 engage with the principal locking parts on the spacer 20 (principal locking protrusions 26 in FIG. 3) and the spacer 20 is held (fixed) at the principal locking position.

As shown in FIGS. 1 and 2, the spacer 20 includes a plurality of terminal insertion through parts 22, 23 between the two outside walls 21 which are opposed to each other in the widthwise direction of the housing body 10. Each of the terminal insertion through parts 22, 23 is provided with a terminal locking protrusion 24 which engages with the recess of the terminal metal fitting when the spacer 20 is moved to the principal locking position to prevent the terminal metal fitting from falling out.

The spacer 20 of the present embodiment is inserted into the spacer accommodating space 12 along a direction which is perpendicular to the direction the terminal metal fittings are inserted into the terminal accommodating holes 11 (the direction shown by the arrow Y3 in FIG. 2), and is positioned at two positions, that is, the temporary locking position and the principal locking position, by the first component locking means 15 and the second component locking means 16 which are equipped on the housing body 10.

The temporary locking position is a position where the terminal locking protrusions 24 of the spacer 20 are held not to project into the terminal accommodating holes of the housing body 10, and the terminal metal fittings can be detached from the terminal accommodating holes 11 of the housing body 10. The principal locking position is a position where the spacer 20 is further pushed into the housing from the temporary locking position, the terminal locking protrusions 24 of the spacer 20 project into the terminal accommodating holes 11 to engage with the terminal metal fittings, and the terminal metal fittings are prevented from falling out.

When the spacer 20 is moved to the principal locking position, since the terminal locking protrusions 24 engage with the terminal metal fittings which are held by the lances in the housing body 10, the terminal metal fittings are double locked by being double held by the lances and the terminal locking protrusions 24.

The spacer 20 of the present embodiment includes the temporary locking protrusions 25 which are the temporary locking parts and the principal locking protrusions 26 which are the principal locking parts.

The temporary locking protrusions 25 and the principal locking protrusions 26, as shown in FIG. 3, are protrusions which protrude from the surfaces of the outside walls 21 in the board thickness direction (an arrow T direction in FIG. 3).

The temporary locking protrusions 25, as shown in FIG. 3, are equipped on the outer wall surfaces 21*a* of the outside walls 21, and as shown in FIG. 4B, when the spacer 20 is moved to the temporary locking position, the temporary locking protrusions 25 climb over and engage with the first component locking means 15 to regulate the movement of the spacer 20 in the insertion direction.

When the spacer 20 is moved to the temporary locking position and the temporary locking protrusions 25 engage with the first component locking means 15, as shown in FIG. 4B, pressing loads F1 are applied on the temporary locking protrusions 25 from the first component locking means 15. The pressing loads F1 are loads which bias the outside walls 21 to the inside of the housing body 10 in the widthwise direction.

The principal locking protrusions 26, as shown in FIG. 3, are equipped on the inner wall surfaces 21*b* of the outside walls 21, and as shown in FIG. 4C, when the spacer 20 is moved to the principal locking position, the principal locking protrusions 26 climb over and engage with the second component locking means 16 to regulate the movement of the spacer 20 in the insertion direction.

When the spacer 20 is moved to the principal locking position and the principal locking protrusions 26 engage with the second component locking means 16, as shown in FIG. 4C, pressing loads F2 are applied on the principal locking protrusions 26 from the second component locking means 16. The pressing loads F2 are loads which bias the outside walls 21 to the outside of the housing body 10 in the widthwise direction.

That is, for the connector 1 of the present embodiment, as shown in FIGS. 4B and 4C, the pressing loads F1 which are applied on the temporary locking protrusions 25 which engage with the first component locking means 15 and the pressing loads F2 which are applied on the principal locking protrusions 26 which engage with the second component locking means 16 are in opposite directions.

For the spacer 20 of the present embodiment, the temporary locking protrusions 25 and the principal locking protrusions 26 on the outside walls 21, as shown in FIG. 3, are arranged at different positions separated by a distance L1 in the direction the spacer 20 is inserted (an arrow Y4 direction in FIG. 3).

For the connector 1 of the present embodiment, when the principal locking protrusions 26 are attached/detached to/from the second component locking means 16, since the temporary locking protrusions 25 abut against the first opposed wall surfaces 13*a*, the temporary locking protrusions 25 function as supporting points to support the principal locking protrusions 26 and the bending displacement of the principal locking protrusions 26 to the side of the first opposed wall surfaces 13*a* is regulated. In other words, as shown in FIG. 4C, although the principal locking protrusions 26 are bended and displaced to the side of the first opposed wall surfaces 13*a* due to the pressing loads F2 from the second component locking means 16, since the bending displacement at this time is restricted since the temporary locking protrusions 25 abut against the first opposed wall surfaces 13*a*, and the bending displacement is permitted in a range of the distance L1, the fixing strength of the engagement of the second component locking means 16 and the principal locking protrusions 26 can be improved.

For the connector 1 of the present embodiment, when the temporary locking protrusions 25 are attached/detached to/from the first component locking means 15, since the principal locking protrusions 26 abut against the second opposed wall surfaces 13*b*, the bending displacement of the temporary locking protrusions 25 to the side of the second opposed wall surfaces 13*b* is regulated. In other words, as shown in FIG. 4B, although the temporary locking protrusions 25 are bended and displaced to the side of the second opposed wall surfaces 13*b* due to the pressing loads F1 from the first component locking means 15, the bending displacement at this time is restricted since the principal locking protrusions 26 abut against the second opposed wall surfaces 13*b*, and the fixing strength of the engagement of the first component locking means 15 and the temporary locking protrusions 25 can be improved.

For the connector 1 of the embodiment described above, the temporary locking protrusions 25 and the principal locking protrusions 26, which the spacer 20 is equipped with to position the spacer 20 to the temporary locking position and the principal locking position, are provided on the surfaces of the outside walls 21 of the spacer 20, and the loads which are applied on the temporary locking protrusions 25 or the principal locking protrusions 26 from the first component locking means 15 of the housing body 10 side are the loads in the board thickness direction of the outside walls 21 which make the outside walls 21 easy to be bended.

Therefore, it is possible to reduce an operating force that is necessary when the temporary locking protrusions 25 or the principal locking protrusions 26 are attached/detached to/from the component locking means 15 or 16. In other words, the resistant force when the temporary locking protrusions 25 or the principal locking protrusions 26 of the spacer 20 are attached/detached to/from the component locking means 15 and 16 is reduced, and it can be easy to install the spacer 20 into the housing body 10.

Besides, since the temporary locking protrusions 25 and the principal locking protrusions 26 which are equipped on the spacer 20 are separately equipped on the outside and inside of the outside walls 21, as shown in FIGS. 4B and 4C, the pressing loads F1 which are applied on the temporary locking protrusions 25 which engage with the first component locking means 15 and the pressing loads F2 which are applied on the principal locking protrusions 26 which engage with the second component locking means 16 are in opposite directions.

Therefore, even if the spacer 20 is repeatedly attached/detached to/from the housing body 10, loads in a specific direction will not be applied continuously, and the outside walls 21 can be prevented from being bended and deformed plastically in a specific direction or damaged.

Therefore, even if the spacer 20 is repeatedly attached/detached to/from the housing body 10, the spacer 20 can be prevented from being deformed and damaged.

For the connector 1 of the embodiment described above, when the spacer 20 is inserted and installed into the housing body 10, the first opposed wall surfaces 13*a* and the second opposed wall surfaces 13*b* equipped on the housing body 10 sandwich the outside walls 21 of the spacer 20 and function as guiding parts which guide the spacer 20 to the insertion direction.

Therefore, the operation of inserting the spacer 20 can be stabilized and it can be easy to install the spacer 20.

For the connector 1 of the embodiment described above, since the temporary locking protrusions 25 and the principal locking protrusions 26 on the outside walls 21 are set to be arranged at different positions separated by the distance L1 in the direction the spacer 20 is inserted, the application points where the pressing loads (bending loads) are applied on the outside walls 21 from the first component locking means 15 at the time of temporary locking and the application points where the pressing loads (bending loads) are applied on the outside walls 21 from the second component locking means 16 at the time of principal locking are positioned at different positions separated by the distance L1 in the direction the spacer 20 is inserted. Therefore, since the pressing loads from the component locking means 15 and 16 are received separately on different application points, even if the spacer 20 is repeatedly attached/detached to/from the housing body 10, the frequency of applying the pressing loads on the same application points is reduced by half, and the occurrence of fatigue due to repeated loads can be prevented.

For the connector 1 of the embodiment described above, the two locking parts, which are the temporary locking protrusions 25 and the principal locking protrusions 26, abut against the opposed wall surfaces 13*a* and 13*b* which face each other, respectively, to regulate the other locking parts from being bended and displaced to the side opposite to the opposed wall surfaces which are opposed to the other locking parts.

That is, the bending stiffness of the temporary locking protrusions 25 and the principal locking protrusions 26 is reinforced since the locking parts of the other side abut against the opposed wall surfaces and becomes the supporting points, and the fixing strength of the temporary locking protrusions 25 and the principal locking protrusions 26 is improved since the temporary locking protrusions 25 and the principal locking protrusions 26 engage with the component locking means 15 and 16.

Therefore, the fixing strength of the spacer 20 at the temporary locking position and the principal locking position can be improved without, for example, increasing the board thickness of the outside walls 21.

The invention is not restricted to the above-described embodiment, and suitable modifications, improvements and the like can be freely made. Moreover, the materials, shapes, dimensions, numerical values, forms, numbers, installation places and the like of the components are arbitrarily set as far as the invention can be attained, and not particularly restricted.

For example, the position deviation amount of the principal locking protrusions 26 and the temporary locking protrusions 25, or the exact shapes of the locking protrusions 25 and 26 in the embodiment described above can be modified appropriately.

For the connector of the present invention, the insertion-installed component which is inserted and installed into the housing body is not limited to the spacer which double locks the terminal metal fittings, a holder which positions the terminal metal fittings is also possible.

Although the invention is described in detail with reference to specific embodiments, it is apparent that various modifications and amendments may be made by those skilled in the art without departing from the spirit and scope of the invention.

This application is based on the Japanese patent application (patent application No. 2011-158292) filed on Jul. 19, 2011, whose content is incorporated herein by reference.

The features of the embodiment of the connector according to the present invention described above are briefly, collectively listed in the following [1] to [3], respectively.

[1] A connector (1) comprising:

a housing body (10); and an insertion-installed component (20) which is inserted into a component accommodating space (12) formed in the housing body (10) and which can be positioned at two positions, which are different positions in the insertion direction and which are a temporary locking position and a principal locking position, by component locking means (15, 16) which are equipped in the housing body (10), wherein the insertion-installed component (20) includes:

a temporary locking part (25) which is equipped on one side surface (21*a*) of an outside wall (21) of the insertion-installed component (20) and which engages with the component locking means (15) to regulate the movement of the insertion-installed component (20) in the insertion direction when the insertion-installed component (20) is moved to the temporary locking position; and a principal locking part (26) which is equipped on the other side surface (21*b*) of the outside wall (21) and which engages with the component locking means (16) to regulate the movement of the insertion-installed component (20) in the insertion direction when the insertion-installed component (20) is moved to the principal locking position, and a pressing load applied on the temporary locking part (25) that engages with the component locking means (15) and a pressing load applied on the principal locking part (26) that engages with the component locking means (16) are in opposite directions.

[2] The connector (1) according to the above [1], wherein the housing body (10) includes a first opposed wall surface (13*a*) which is opposed to the one side surface (21*a*) of the outside wall (21);

a second opposed wall surface (13*b*) which is provided to be opposed to the other side surface (21*b*) of the outside wall (21) and which, together with the first opposed wall surface (13*a*), sandwiches the outside wall 21 to be movable in the insertion direction of the insertion-installed component (20) is inserted;

a first component locking means (15) which is equipped on the first opposed wall surface (13*a*) and engages with the temporary locking part (25) when the insertion-installed component (20) is moved to the temporary locking position; and a second component locking means (16) which is equipped on the second opposed wall surface (13*b*) and engages with the principal locking part (26) when the insertion-installed component (20) is moved to the principal locking position.

[3] The connector (1) according to the above [2], wherein the temporary locking part and the principal locking part are protrusions which protrude from the surfaces of the outside wall (21) in the board thickness direction and are arranged at different positions in the insertion direction of the insertion-installed component (20), the temporary locking part (25) abuts against the first opposed wall surface (13*a*) to regulate the principal locking part (26) from being bended and displaced to the side of the first opposed wall surface (13*a*), and the principal locking part (26) abuts against the second opposed wall surface (13*b*) to regulate the temporary locking part (25) from being bended and displaced to the side of the second opposed wall surface (13*b*).

INDUSTRIAL APPLICABILITY

According to the connector of the present invention, the loads which are applied on the temporary locking parts and the principal locking parts from the component locking means of the housing body side are the loads in the board thickness direction of the outside walls which make the outside walls easy to be bended. Therefore, when the temporary locking parts or the principal locking parts are attached/detached to/from the component locking means, displacement at the temporary locking position or the principal locking position may be enable by a small operating force, and it can be easy to install the insertion-installed component into the housing body.

Besides, since the temporary locking parts and the locking parts which are equipped on the insertion-installed component are separately equipped on the outside and inside of the outside walls, the pressing loads which are applied on the locking protrusions which engage with the component locking means are in opposite directions.

Therefore, even if the insertion-installed component is repeatedly attached/detached to/from the housing body, loads in a specific direction will not be applied continuously, and the outside walls can be prevented from being bended and deformed plastically in a specific direction or damaged.

Therefore, even if the insertion-installed component is repeatedly attached/detached to/from the housing body, the insertion-installed component can be prevented from being deformed and damaged.

REFERENCE SIGNS LIST

1 connector
10 housing body
12 spacer accommodation space (component accommodating space)
13 side wall guiding space
13*a* first opposed wall surface
13*b* second opposed wall surface
15 first component locking means (component locking means)
16 second component locking means (component locking means)
20 spacer (insertion-installed component)
21 outside wall
21*a* outer wall surface
21*b* inner wall surface
25 temporary locking protrusion (temporary locking part)
26 principal locking protrusion (principal locking part)

The invention claimed is:

1. A connector comprising:

a housing body; and an insertion-installed component which is inserted into a component accommodating space formed in the housing body and which can be positioned at two positions, which are different positions in the insertion direction and which are a temporary locking position and a principal locking position, by component locking means which are equipped in the housing body, wherein the insertion-installed component includes:

a temporary locking part, which is equipped on one side surface of an outside wall of the insertion-installed component, and which engages with the component locking means to regulate the movement of the insertion-installed component in the insertion direction when the insertion-installed component is moved to the temporary locking position; and a principal locking part, which is equipped on the other side surface of the outside wall, and which engages with the component locking means to regulate the movement of the insertion-installed component in the insertion direction when the insertion-installed component is moved to the principal locking position, and a pressing load applied on the temporary locking part that engages with the component locking means and a pressing load applied on the principal locking part that engages with the component locking means are in opposite directions, wherein the temporary locking part and the principal locking part are connected by the outside wall at a position where the temporary locking part and a position where the principal locking part are positioned.

2. The connector according to claim 1, wherein the housing body includes:

a first opposed wall surface which is opposed to the one side surface of the outside wall;

a second opposed wall surface which is provided to be opposed to the other side surface of the outside wall and which, together with the first opposed wall surface, sandwiches the outside wall to be movable in the insertion direction of the insertion-installed component;

a first component locking means which is equipped on the first opposed wall surface and engages with the temporary locking part when the insertion-installed component is moved to the temporary locking position; and a second component locking means which is equipped on the second opposed wall surface and engages with the principal locking part when the insertion-installed component is moved to the principal locking position.

3. The connector according to claim 2, wherein the temporary locking part and the principal locking part are protrusions which protrude from the surfaces of the outside wall in a board thickness direction and are arranged at different positions in the insertion direction of the insertion-installed component, the temporary locking part abuts against the first opposed wall surface to regulate the principal locking part from being bended and displaced to a side of the first opposed wall surface, and the principal locking part abuts against the second opposed wall surface to regulate the temporary locking part from being bended and displaced to a side of the second opposed wall surface.

* * * * *